US005085341A

United States Patent [19]

Hodge

[11] Patent Number: 5,085,341

[45] Date of Patent: Feb. 4, 1992

[54] TRASH BIN SYSTEM

[76] Inventor: Allan M. Hodge, P.O. Box 202005, San Diego, Calif. 92120-0925

[21] Appl. No.: 581,458

[22] Filed: Sep. 12, 1990

[51] Int. Cl.[5] ..... B65D 43/16

[52] U.S. Cl. ..... 220/331; 220/335; 220/908

[58] Field of Search ..... 220/315, 908, 244, 329, 220/331, 334, 335; 16/362

[56] References Cited

U.S. PATENT DOCUMENTS

| | | | |
|---|---|---|---|
| Re. 29,494 | 12/1977 | Hodge | 220/334 |
| Re. 30,890 | 3/1982 | Hodge | 220/331 |
| 2,622,761 | 12/1952 | Linde | 220/334 X |
| 2,730,253 | 1/1956 | Oswalt | 214/304 |
| 3,137,408 | 6/1964 | Taylor | 220/35 |
| 3,567,062 | 3/1971 | Reed et al. | 220/335 |
| 3,687,317 | 8/1972 | Gagel | 214/304 |
| 3,951,302 | 4/1976 | Owen | 220/331 |
| 3,989,162 | 11/1976 | Hodge et al. | 220/331 |
| 4,014,457 | 3/1977 | Hodge | 220/331 |
| 4,098,429 | 7/1978 | Hodge | 220/331 |
| 4,148,411 | 4/1979 | Hodge et al. | 220/331 |
| 4,152,979 | 5/1979 | Schmidt | 220/334 X |
| 4,182,530 | 1/1980 | Hodge | 220/1 T X |
| 4,186,844 | 2/1980 | Swanson | 220/333 |
| 4,836,394 | 6/1989 | Glomski | 220/334 X |

*Primary Examiner*—Steven M. Pollard

*Attorney, Agent, or Firm*—Poms, Smith, Lande & Rose

[57] ABSTRACT

A trash bin system used to secure the lids of a trash bin against unauthorized use. The system uses large and small lever arms pivotally engaged to each other that release the lids of the trash bin when the bin is lifted off the ground and inverted for dumping trash. The lever arms lock the lids shut once again after dumping is completed and the trash bin is set back down on the ground again. The small lever arms engage brackets mounted inside the trash bin keeping the lids shut when the bin is on the ground, and disengage from the brackets due to the force of gravity when the trash bin is inverted for dumping operations. A double pivot rear hinge mechanism may be used with each of the trash bin lids. Each mechanism is pivotally coupled to the rear end of one of the lids and to the back of the trash bin, and is used to hold the lid open when the trash bin is resting on the ground allowing a user to place trash into the trash bin.

27 Claims, 3 Drawing Sheets

FIG. 1
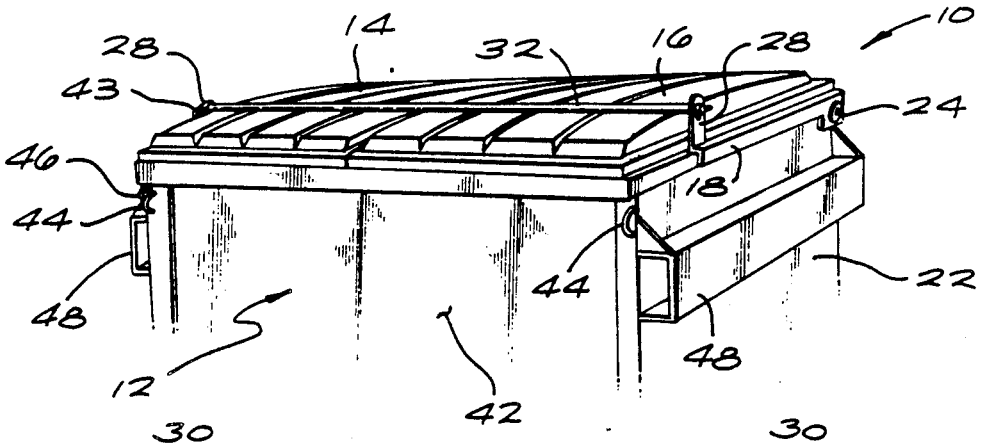
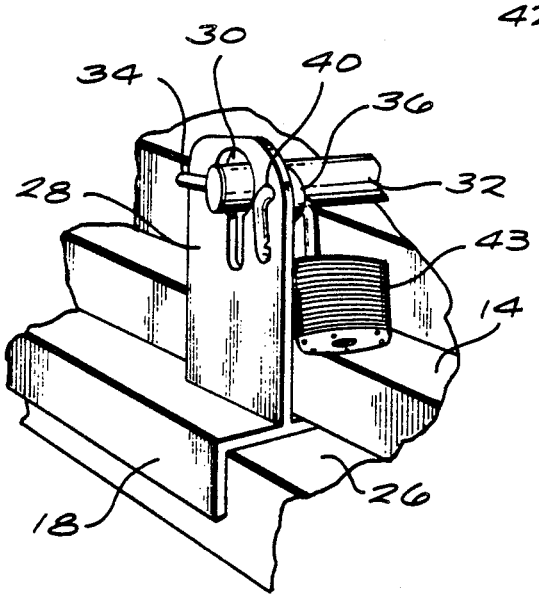
FIG. 2
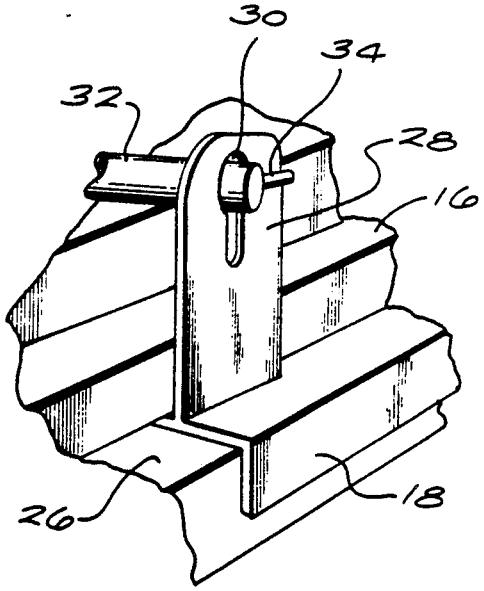
FIG. 3
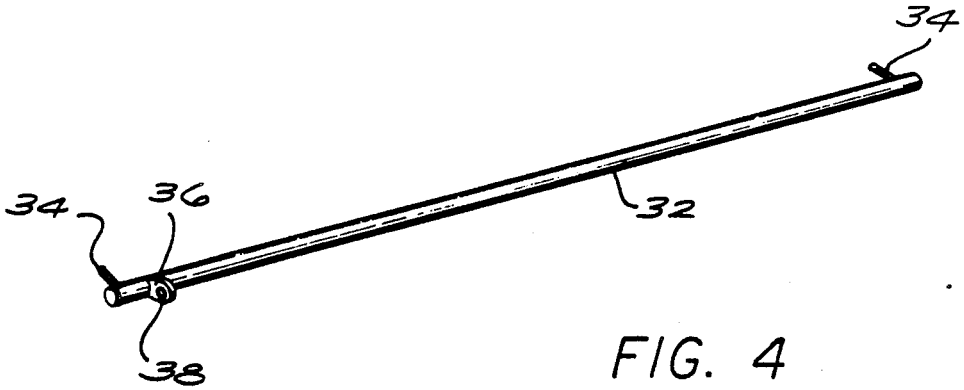
FIG. 4

FIG. 5
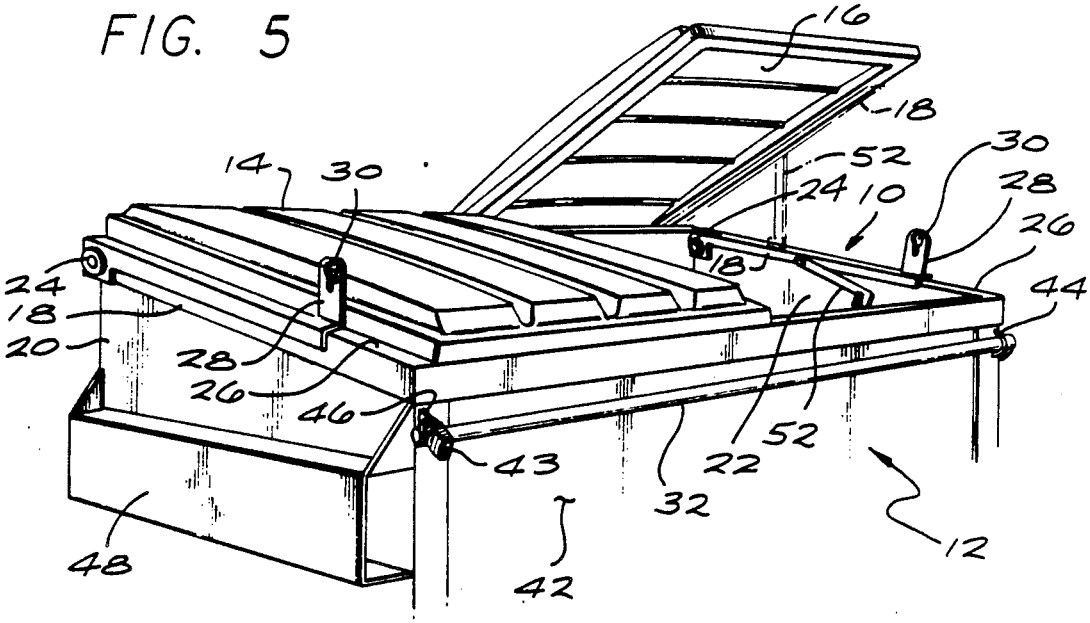
FIG. 6
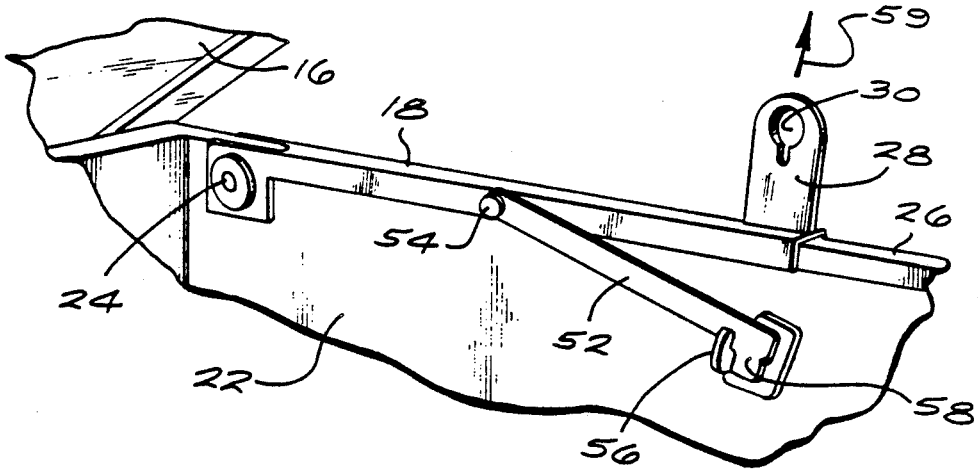
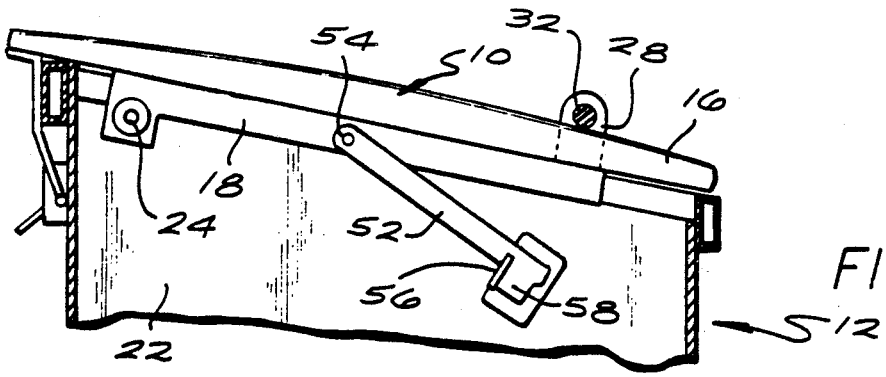
FIG. 7

FIG. 8
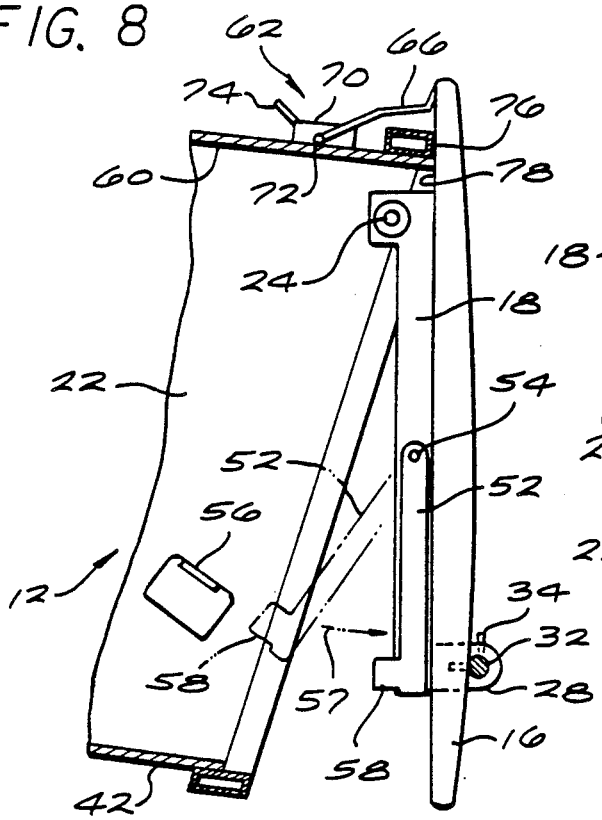
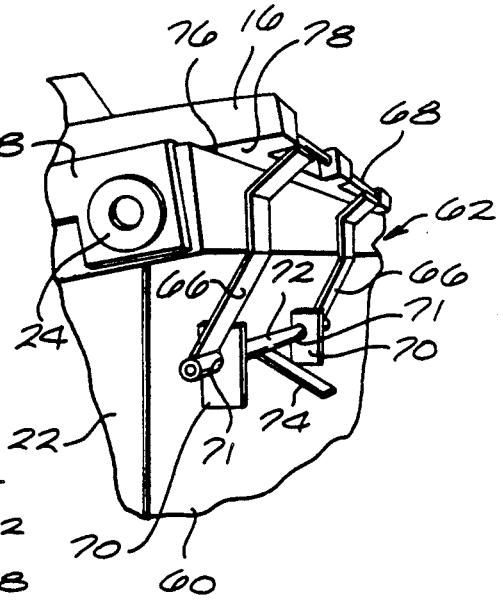
FIG. 9
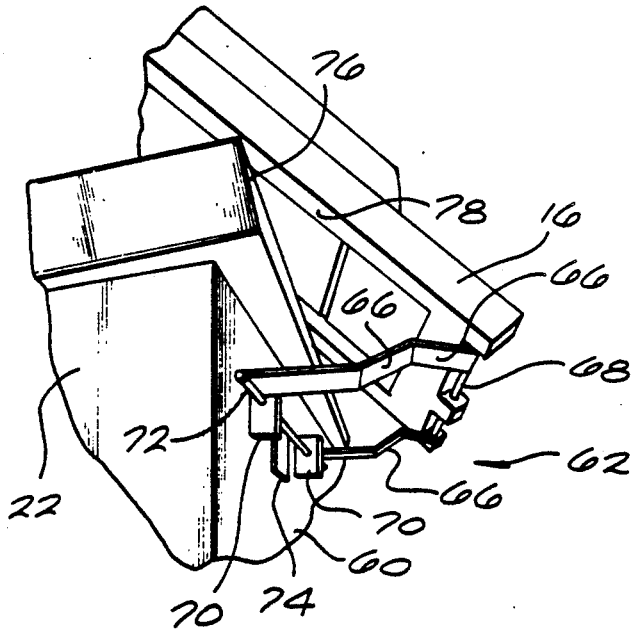
FIG. 10

TRASH BIN SYSTEM

CROSS-REFERENCE TO RELATED APPLICATION

The subject matter of this application is related to the subject matter of my copending application, Ser. No. 07/293,939, filed Jan. 5, 1989, entitled "Trash Bin Lid-Locking Device."

FIELD OF THE INVENTION

The present invention relates to lid locks for commercial trash bins, and to arrangements for holding a lid open for the deposit of trash.

BACKGROUND OF THE INVENTION

In the past, users of trash bins and owners of commercial trash bins have experienced difficulty in preventing unauthorized use of the bins. As a result, various locking devices or systems have been designed for trash bins in order to control access to the bins. For example, my prior U.S. Pat. No. 4,182,530, issued on Jan. 8, 1980, discloses a commercial trash bin locking system using a gravity-operated latch releasing mechanism to prevent unauthorized use of a trash bin while still permitting the dumping of trash by lifting and inverting the trash bin without the need to manually open or unlock the trash bin prior to lifting the bin. My U.S. Pat. No. 29,494, reissued on Dec. 13, 1977, describes another gravity-operated trash container lid system. Another such lid lock device which automatically opens the lids of a trash bin during dumping operations without the need for manual operation is disclosed in U.S. Pat. No. 3,687,317, issued to Gagel on Aug. 29, 1972.

Other gravity-operated trash bin lid systems using roller tracks to operate and which will remain partially open for the deposit of trash, are disclosed in U.S. Pat. No. 3,951,302 issued to Owen on Apr. 20, 1976, and in my prior U.S. Pat. Nos. 30,890, reissued on Mar. 30, 1982, and 4,148,411 issued Apr. 10, 1979. Other gravity-operated trash bin systems using lever arms are disclosed in my U.S. Pat. Nos. 4,098,429 issued on July 4, 1978, 4,014,457 issued Mar. 29, 1977, and 3,989,162 issued Nov. 2, 1976. Attention is further directed to R. Swanson U.S. Pat. No. 4,186,844 in which a special trash bin and lid configuration permits holding of the lid in the partially open configuration. However, the lids of the patents described hereinabove were generally formed of steel and utilized mechanical arrangements which supported the heavy lids as they were being opened.

U.S. Pat. No. 2,730,253 issued to Oswalt on Jan. 10, 1956, describes a trip means used for opening ends of fruit boxes. A pail with a lid and latching mechanism is disclosed in U.S. Pat. No. 3,137,408 issued to Taylor on June 16, 1964. A hinge bracket is used to hold the lid open.

However, some of these locking devices and systems are, somewhat complex, expensive to manufacture, or can only be used for a particular size or type of trash bin. Accordingly, there are needs for a simple trash bin system and/or mechanism for holding lids partially open, which may be installed on different types of trash bins and is economical to manufacture and simple to use.

SUMMARY OF THE INVENTION

It is one object of this invention to provide a trash bin system that may be used to keep the lids of a trash bin closed, preventing unauthorized use of the bin, and allows a user to easily open the lids.

It is another object of this invention to provide a trash bin system that is gravity operated allowing the lids of the trash bin to open when the bin is inverted during dumping operations.

It is still another object of this invention to provide a trash bin system that may be easily installed on different types of bins of varying sizes and configurations.

It is still another object of this invention to provide a trash bin system that is economical to manufacture.

Another object of the invention is to provide a simple and convenient way to hold the lid of a commercial trash bin partially open, for the deposit of trash.

These and other objects and advantages are attained by an illustrative trash bin system used to secure the lids of a trash bin against unauthorized use. The system uses large and small lever arms pivotally engaged to each other that release the lids of the trash bin when the bin is lifted off the ground and inverted for dumping trash. The lever arms lock the lids shut once again after dumping is completed and the trash bin is set back down on the ground again. The small lever arms engage brackets mounted inside the trash bin keeping the lids shut when the bin is on the ground, and disengage from the brackets due to the force of gravity when the trash bin is inverted for dumping operations. The assembly may also include arrangements for holding the lid in the partially open configuration, for easy deposit of trash. This may include pivoting the small lever arm to engage the upper rim of the bins or a special double pivot rear hinge mechanism.

The special double pivot rear hinge mechanism may be used with each of the trash bin lids as mentioned above. Each mechanism is pivotally coupled to the rear end of one of the lids and through a short linkage to the back of the trash bin, and is used to hold the lid partially open when the trash bin is resting on the ground allowing a user to place trash into the trash bin. The new arrangements are particularly applicable to use with standard configuration commercial trash bins, and the new lightweight plastic lids which do not require full support while the lid is being raised to an intermediate partially open configuration.

The double pivot linkage preferably extends downward from the rear edge of the lid substantially vertically, or at an angle of not more than 45 degrees from vertical so that as the lid is raised, it may be moved to the rear to engage the upper rear edge of a standard commercial trash bin at a point spaced forward from the rear edge of the lid. Further, the length of the linkage from pivot point to pivot point should be substantial, at least one-tenth of the front-to-back length of the lid, and preferably about one-fifth of this front-to-back lid length, with a range of between about one-third to one-eighth of the front-to-back dimension of the lid being preferred.

The various features of the present invention will be best understood together with further objects and advantages by reference to the following description of the preferred embodiment taken in conjunction with the accompanying drawings.

BRIEF DESCRIPTION OF THE DRAWINGS

FIG. 1 is a right front perspective view of a trash bin system illustrating the principles of the present invention, showing how an elongated bar may be placed on top of the trash bin lids and used with the system to keep the lids closed;

FIG. 2 is an enlarged detailed view showing how one end of the bar may be removably secured by a padlock to a lug attached to one of two large lever arms located at one side of the bin;

FIG. 3 is an enlarged detailed view showing how the other end of the bar may be removably secured to another lug attached to the other large lever arm at the opposite side of the bin;

FIG. 4 is a perspective view of the bar;

FIG. 5 is a left front perspective view of the trash bin showing how one of the trash bin lids may be opened after the elongated bar is removed from on top of the lids and removably secured to the front of the trash bin, and showing in dashed lines how one of the large lever arms and one of two small lever arms may be used to assist in holding a lid partially open;

FIG. 6 is an enlarged perspective view of the trash bin of FIG. 5 with one of the lids opened showing how one of the large lever arms is pivoted to the side of the trash bin and rests on top of the side of the bin, and how one of the two small lever arms is pivoted to the larger lever arm and removably engages a bracket attached to the side of the bin;

FIG. 7 is a partial cross-sectional view of the trash bin showing the lids in a closed position with the elongated bar on top of the lids;

FIG. 8 is a partial cross-sectional view of the trash bin after the bin has been lifted off the ground during dumping operations showing how the small lever arms disengage from their corresponding brackets due to gravity allowing the trash bin lids to open;

FIG. 9 is an enlarged detailed view of the back of the trash bin showing the trash bin lids shut and a double pivot rear hinge mechanism pivotally coupled to the rear end of one of the trash bin lids and to the back of the bin; and FIG. 10 is an enlarged detailed view of the back of the trash bin showing how the double pivot rear hinge mechanism may be used to hold the trash bin lids open.

DESCRIPTION OF THE PREFERRED EMBODIMENT

The following specification taken in conjunction with the drawings sets forth the preferred embodiment of the present invention in such a manner that any person skilled in the art can make and use the invention. The embodiment of the invention disclosed herein is the best mode contemplated by the inventor for carrying out his invention in a commercial environment, although it should be understood that various modifications can be accomplished within the parameters of the present invention.

FIGS. 1 through 6 show a preferred embodiment of the trash bin system 10 of the present invention. The system 10 may be installed on different types of trash bins such as the trash bin 12 shown having lids 14 and 16. However, it is important to note that the system 10 may be installed on any type of trash bin having lids at the top of the bin 12 that open in an upward direction as shown in FIG. 5 when the bin 12 is resting on the ground. In addition, the system 10 may be used for a trash bin 12 having only one lid (not shown).

The trash bin system 10 has two large lever arms 18 pivotally engaged to the sides 20, 22 of the trash bin 12 at pivot points 24. Pivot points or joints 24 may be formed by nuts and bolts, washers connected by rivets (as shown), screws, pins or the like. Lever arms 18 may be formed by U-shaped channels, brackets, L-shaped members or the like, and each arm 18 preferably rests on a corresponding top 26 of one of the trash bin sides 20, 22 as shown in FIG. 5. Each large lever arm 18 has attached to the top of it a lug 28 with a key-shaped aperture 30 therein. It is important to note that other shaped apertures may be used instead of the key-shaped apertures 30.

As shown in FIG. 1, an elongated bar 32 is used to secure the lids 14, 16 shut by inserting or engaging the ends of the bar 32 into the key-shaped apertures 30 in the lugs 28 as illustrated in FIGS. 2 and 3. The bar 32 has small extensions 34 attached to the ends thereof that prevent the ends of the bar 32 from disengaging from the apertures 30 when the bar 32 is rotated as shown in FIGS. 2 and 3. As best shown in FIGS. 2 and 4, the bar 32 also has a lug 36 (with an aperture 38 therein) attached to it near one of the ends of the bar 32. FIG. 2 illustrates how a padlock 42 may be used to removably secure the bar 32 to lug 28 by using apertures 38, 40 in lugs 36, 28, respectively.

Each large lever arm 18 has a corresponding small lever arm 52 pivotally coupled to it at joint or pivot point 54 (see FIGS. 6, 7 and 8). Joints 54 may comprise pins, bolts and nuts, rivets, screws, or the like. A bracket 56 is mounted on each of the sides 20, 22 of the trash bin 12. End 58 of each lever arm 52 removably engages a corresponding one of the brackets 56 so that ends 58 will not disengage from brackets 56 when the trash bin 12 is resting on the ground and upward forces in the direction of arrow 59 (see FIG. 6) are applied to lugs 28 by the bar 32. Upward forces in the direction of arrow 59 cause the ends of lever arms 52 to pivot and move slightly upward at joint 54. This action forces ends 58 of arms 52 into contact with brackets 56, preventing upward movement of lever arms 18, bar 32 and lids 14, 16. As a result, the trash bin lids 14 and 16 cannot be opened when the bar 32 rests on top of the lids 14, 16 and is secured to the lugs 28 by the padlock 42, or by some other securing means. Therefore, access to the trash bin may be controlled by giving keys to the padlock only to authorized users.

The trash bin system 10 described above is a gravity-actuated system which allows the lids 14, 16 of trash bin 12 to be opened when the bin is lifted off the ground an inverted during dumping operations. Hollow channels 48 at the sides 20, 22 of the trash bin 12 may be used to lift the bin 12 by inserting forklift-like arms from, e.g., a garbage truck, into the channels 48 for the purpose of lifting the bin 12. As such, the trash bin 12 may be lifted to a position as illustrated in FIG. 8. When in this position, gravity causes the small lever arms 52 to disengage from brackets 56 and to rotate about pivot point or joint 54 in the direction of arrow 57 shown in FIG. 8 until the arms 52 come into contact with the lids 14, 16 which have also rotated open under the force of gravity. Note that large lever arms 18 rotate about joint or pivot point 24 until the arms 18 also come into contact with the lids 14, 16. The trash bin 12 may be inverted until it is nearly upside down for the purpose of dumping trash into a garbage truck.

After trash is emptied into the garbage truck, the trash bin 12 may be set back on the ground in an upright position. Gravity causes the lids 14, 16 to shut when the trash bin 12 is in an upright position, the large lever arms 18 to come to rest on top of the bin, and ends 58 of the small lever arms 52 to engage brackets 56. As a result, the lids 14, 16 are once again locked shut, on top of the trash bin 12.

As illustrated by dashed lines in FIG. 5, one of the small and large lever arms, 52 and 18 respectively, may be used to hold lid 16 in a partially open position. This may be accomplished by rotating the large lever arm 18 upward as shown about pivot point 24 and then rotating the small lever arm 52 about pivot point 54 so that end 58 rests on top 26 of side 22. Trash may then be conveniently dumped into the trash bin 12.

FIGS. 9 and 10 show a double pivot rear hinge mechanism 62 which may also be used to hold one of the lids 14, 16 in an open position after the bar 32 is removed from on top of the lids 14, 16. In order to mount the removed bar 32 to the front of the trash bin 12, the ends of the bar 32 may be inserted into U-rings 44 attached to the front 42 of the trash bin 12 (see FIGS. 1 and 5). Padlock 42 may also be used to removably secure lug 36 at the end of the bar 32 to lug 46 disposed near one of the U-rings 44. Any other type of rings or brackets may be used instead of U-rings if desired.

The double pivot rear hinge mechanism 62 features a pair of elongated linkages or plates 66. The bottom end of each elongated plate is attached to a rod 72 which rotatably engages apertures 71 in two plates 70 mounted on a rear 60 of the trash bin 12. The top end of each elongated plate is rotatably engaged to a rod 68 attached to the rear end of one of the lids 14, 16. It is important to note that a double pivot rear hinge mechanism 62 may be used for each of the trash bin lids 14, 16.

As illustrated in FIG. 10, the hinge mechanism 62 may be used to hold one of the lids 14, 16 of the trash bin 12 open so that a user may place trash into the bin. When a user pushes one of the lids 14, 16 open, the lid slides backward with bottom side 78 of the lid sliding on top 76 at the rear 60 of the trash bin 12. As the lid slides backward, rod 72 rotates in apertures 71 and the top ends of the elongated plates 66 rotate about rod 68. The lid continues to slide backward until plate 74 attached to rod 72 comes into contact with the rear 60 of the trash bin. As such, plate 74 stops backward movement of the lid and holds the lid in place as shown in FIG. 10.

The lid may be returned to its closed position by merely pulling the lid forward causing it to slide on top 76 of the trash bin 12 until it rotates down on top of the bin forcing end 58 of lever arm 52 into engagement with bracket 56. Bar 32 may then be secured on top of the lids 14, 16 as described above.

The above description discloses the preferred embodiments of the present invention. However, persons of ordinary skill in the art are capable of numerous modifications once taught these principles such as, by way of example and not limitation, a flexible cable may be used instead of the elongated bar 32. A clamp, spring device, or the like, may be used instead of the lugs 28 to removably secure the ends of the bar 32 to the large lower arms 18.

For completeness, with reference to the double pivot arrangement shown in FIGS. 9 and 10, it could be implemented by other equivalent arrangements. Thus, by way of example and not of limitation, a single rod, of perhaps ½ inch or ⅜ inch diameter, could be bent to form both of the linkages and one or both of the shafts 68 and 72. It is also noted that, in the particular embodiment shown, the lightweight plastic lid was approximately 47 inches from front-to-back, and the length of the linkages between pivot points, from rod 72 to rod 68 was approximately 9½ inches, with the linkage length being about one-fifth of the front-to-back lid dimension. This was for a commercial trash bin for holding three cubic yards of trash.

More generally, it is desirable that the length of the linkage is between about ⅓ and ⅛ of the front-to-back lid dimensions. However, the indicated length of about 9½ inches serves to accommodate most standard commercial trash bins. It is further noted that it is normally desirable to use standard types of commercial trash bins, which have not been significantly modified, as indicated in the Swanson patent, for example, so that the lightweight lids and double pivot arrangements may be added with minimum labor and cost.

Concerning one additional point, the angle of the linkages from pivot point to pivot point should be nearly vertical, so that, upon opening of the lid, it may be shifted to the rear on the upper rear edge of the trash container. A small angle such as 15 degrees or 30 degrees is still operative, but an angle for the linkage of more than 45 degrees is preferably avoided.

In the case of the double pivot rear hinge mechanism 62, rod 72 may be fixed to plates 70 and the bottom ends of the elongated plates 66 may be rotatably mounted onto rod 72. Also, rod 68 may be rotatably mounted onto the rear end of one of the lids 14, 16, and the upper ends of plates 66 may be fixed to rod 68. Also, springs may be used with the supporting hinge mechanism 62 in order to better support or cushion one of the trash bin lids 14, 16. Accordingly, it will be understood by those skilled in the art that changes in form and details may be made to the above described embodiment without department from the spirit and scope of the invention.

I claim:

1. A trash bin system used to secure the lids of a trash bin comprising:

an elongated bar;

first lever arm means pivotally engaged to opposite sides of said trash bin for removably engaging said bar;

second lever arm means pivotally engaged to said first lever arm means for selectively preventing said lids from opening when said trash bin is oriented in an upright position, and for selectively allowing said lids to open when said trash bin is oriented in an inverted position; and bracket means attached to said opposite sides of said trash bin for selectively and removably engaging said second lever arm means, said second lever arm means adapted to disengage from said bracket means due to gravitational forces when said trash bin is oriented in said inverted position.

2. The trash bin system of claim 1 further comprising hinge means for holding said lids in an open position when said trash bin is oriented in said upright position, each of said supporting hinge means including:

an elongated plate having one end pivotally coupled to a rear end of a corresponding lid, and an opposite end thereof pivotally coupled to a rear of said trash bin so that said corresponding lid is adapted to slide in forward and backward directions on a top of said rear of said trash bin facilitating opening and closing of said corresponding lid; and a supporting plate coupled to said opposite end of said elongated plate so that said supporting plate is adapted to limit rotation of said opposite end and to limit backward movement of said corresponding lid in order to hold said corresponding lid in an open position when said trash bin is oriented in said upright position.

3. The trash bin system of claim 2 wherein said one end of said elongated plate rotatably engages a first rod mounted at said rear end of said corresponding lid, and said opposite end is attached to a second rod rotatably engaged to said rear of said trash bin, said supporting plate being attached to said second rod so that said supporting plate rotates with said second rod.

4. The trash bin system of claim 1 wherein each of said first lever arm means has a lug mounted thereon with an aperture therein, said elongated bar having ends adapted to removably engage said apertures in said lugs.

5. The trash bin system of claim 4 wherein said elongated bar has a lug near one end thereof adapted to be removably secured to a corresponding one of said lugs mounted on said first lever arm means in order to lock said lids of said trash bin shut.

6. The trash bin system of claim 5 wherein said elongated bar has small extensions at both ends thereof in order to prevent said ends of said bar from disengaging from said apertures in said lugs mounted on said first lever arm means.

7. A double pivot hinge mechanism used to hold the lids of a trash bin, having front, rear, and two side walls, in a partially open position when said trash bin is oriented in an upright position, said hinge mechanism comprising:

an elongated plate having one end pivotally coupled to a rear end of a corresponding lid, and an opposite end thereof pivotally coupled at a fixed pivot point on said rear wall of said trash bin so that said corresponding lid is adapted to slide in forward and backward directions on a top edge of said rear wall of said trash bin while remaining in contact with said top edge in order to facilitate opening and closing of said corresponding lid; and a supporting plate coupled to said opposite end of said elongated plate so that said supporting plate is adapted to limit rotation of said opposite end and to limit backward movement of said corresponding lid in order to hold said corresponding lid in an open position when said trash bin is oriented in said upright position.

8. The trash bin system of claim 7 wherein said one end of said elongated plate rotatably engages a first rod mounted at said rear end of said corresponding lid, and said opposite end is attached to a second rod rotatably engaged to said rear of said trash bin, said supporting plate being attached to said second rod so that said supporting plate rotates with said second rod.

9. The double pivot hinge mechanism of claim 8 wherein said second rod is rotatably engaged to two plates mounted on said rear of said trash bin.

10. A trash bin system used to secure the lids of a trash bin comprising:

an elongated bar;

a pair of first lever arms adapted to removably engage said elongated bar, each of said first lever arms being pivotally engaged to opposite sides of said trash bin;

a pair of second lever arms, each of said second lever arms being pivotally engaged to a corresponding one of said first lever arms; and bracket means attached to said opposite sides of said trash bin for selectively and removably engaging said second lever arms when said trash bin is oriented in an upright position, said second lever arms adapted to disengage from said bracket means due to gravitational forces when said trash bin is oriented in an inverted position allowing said lids to open.

11. The trash bin system of claim 10 wherein each of said first lever arms has a lug mounted thereon with an aperture therein, said elongated bar having ends adapted to removably engage said apertures in said lugs.

12. The trash bin system of claim 11 wherein said elongated bar has a lug near one end thereof adapted to be removably secured to a corresponding one of said lugs mounted on said first lever arms in order to lock said lids of said trash bin shut.

13. The trash bin system of claim 12 wherein said elongated bar has small extensions at both ends thereof in order to prevent said ends of said bar from disengaging from said apertures in said lugs mounted on said first lever arms.

14. A trash bin system used to secure the lids of a trash bin comprising:

an elongated bar;

first lever arm means pivotally engaged to opposite sides of said trash bin for removably engaging said bar;

second lever arm means pivotally engaged to said first lever arm means for selectively preventing said lids from opening when said trash bin is oriented in an upright position, and for selectively allowing said lids to open when said trash bin is oriented in an inverted position;

bracket means attached to said opposite sides of said trash bin for selectively and removably engaging said second lever arm means, said second lever arm means adapted to disengage from said bracket means due to gravitational forces when said trash bin is oriented in said inverted position; and means for holding at least one of said lids in a partially open position in order to facilitate depositing trash in said trash bin.

15. The trash bin system of claim 14 wherein said means for holding said lids partially open comprises:

an elongated plate having one end pivotally coupled to a rear end of a corresponding lid, and an opposite end thereof pivotally coupled to a rear of said trash bin so that said corresponding lid is adapted to slide in forward and backward directions on a top of said rear of said trash bin facilitating opening and closing of said corresponding lid; and a supporting plate coupled to said opposite end of said elongated plate so that said supporting plate is adapted to limit rotation of said opposite end and to limit backward movement of said corresponding lid in order to hold said corresponding lid in an open position when said trash bin is oriented in said upright position.

16. A double pivot hinge mechanism used to hold the lids of a trash bin, having front, rear and two side walls, in a partially open position when said trash bin is oriented in an upright position, said hinge mechanism comprising:

an elongated plate having one end pivotally coupled to a rear end of a corresponding lid, and an opposite end thereof pivotally coupled at a fixed pivot point on said rear wall of said trash bin so that said corresponding lid is adapted to slide in forward and backward directions on a top edge of said rear wall of said trash bin while remaining in contact with said top edge in order to facilitate opening and closing of said corresponding lid.

17. The hinge mechanism of claim 16 further comprising:

means coupled to said elongated plate for limiting rotation of said elongated plate and for holding said corresponding lid in a partially open position.

18. A trash bin system comprising:

a commercial trash bin having front, rear and side walls;

at least one lid on said trash bin;

first and second hinge linkages;

means for pivotally mounting one end of each of said hinge linkages at a rear edge of said lid; and means for pivoting an opposite end of each of said linkages to said trash bin at a fixed pivot point on the rear wall of said bin spaced a distance downward from said rear edge so that said lid is adapted to slide in forward and backward directions on a top edge of said rear wall, while remaining in contact with said top edge in order to facilitate opening and closing of said lid, and to remain stationary in a partially open configuration.

19. A trash bin system as defined in claim 18 further comprising:

means coupled to said linkages for limiting rotation of said linkages and for holding said one lid in a partially open position.

20. A trash bin system as defined in claim 18 wherein said system includes means for supporting said lid in more than one location across its entire width on the back edge of said container when in the partially open configuration.

21. A trash bin system as defined in claim 18 wherein said lid is formed of lightweight plastic and is of a substantially flat configuration.

22. A trash bin system as defined in claim 18 wherein the length of said linkages is at least equal to $\frac{1}{8}$ of the front-to-back dimension of said lid.

23. A trash bin system as defined in claim 18 wherein the length of said linkages is approximately 1/5 the front-to-back dimension of said lid.

24. A trash bin system as defined in claim 18 wherein said linkages extend substantially vertically and not more than thirty degrees from the vertical.

25. A double pivot hinge mechanism used to hold the lids of a trash bin, having front, rear and side walls, in a partially open position when said trash bin is oriented in an upright position, said hinge mechanism comprising:

first and second hinge linkages;

means for pivotally mounting one end of each of said hinge linkages at a rear edge of one of said lids; and means for pivoting an opposite end of each of said linkages to said trash bin at a fixed pivot point on the rear wall of said bin spaced a distance downward from said rear edge so that said lid is adapted to move backward sliding on a top edge of said rear wall while remaining in contact with said top edge until the lid is supported by the rear wall of the container in an open configuration.

26. A trash bin system comprising:

a commercial trash bin having front, rear and two side walls;

at least one lid on said trash bin;

first and second hinge linkages;

means for pivotally mounting one end of each of said hinge linkages at a rear edge of said lid; and means for pivoting an opposite end of each of said linkages to said trash bin at a fixed pivot point on the rear wall of said bin spaced a distance downward from said rear edge of said lid for sliding said lid in forward and backward directions on a top edge of said rear wall of said trash bin, facilitating opening and closing of said lid, and for holding said lid stationary in a partially open configuration, whereby a standard configuration commercial trash bin and lid may be operated to hold the lid partially open through the use of said linkages.

27. A trash bin system comprising:

a commercial trash bin having front, rear and two side walls;

at least one lid on said trash bin;

at least one hinge linkage;

means for pivotally mounting one end of each of said hinge linkages at a rear edge of said lid; and means for pivoting an opposite end of each of said linkages to said trash bin at a fixed pivot point on the rear wall of said bin spaced a distance downward from said rear edge of said lid for sliding said lid in forward and backward directions on a top edge of said rear wall of said trash bin, facilitating opening and closing of said lid, and for holding said lid stationary in a partially open configuration, whereby a standard configuration commercial trash bin and lid may be operated to hold the lid partially open through the use of said linkages.

* * * * *